US007922455B2

(12) United States Patent
Itzel et al.

(10) Patent No.: US 7,922,455 B2
(45) Date of Patent: Apr. 12, 2011

(54) STEAM-COOLED GAS TURBINE BUCKER FOR REDUCED TIP LEAKAGE LOSS

(75) Inventors: Gary Michael Itzel, Simpsonville, SC (US); Philip Lynn Andrew, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 488 days.

(21) Appl. No.: 11/228,241

(22) Filed: Sep. 19, 2005

(65) Prior Publication Data

US 2007/0224049 A1 Sep. 27, 2007

(51) Int. Cl.
*F01D 5/20* (2006.01)

(52) U.S. Cl. ..... 416/228; 415/173.1

(58) Field of Classification Search ..... 415/168.4, 415/173.1, 173.4, 174.4; 416/228
See application file for complete search history.

(56) References Cited

U.S. PATENT DOCUMENTS

| | | | | |
|---|---|---|---|---|
| 4,390,320 | A * | 6/1983 | Eiswerth | 416/97 R |
| 4,589,823 | A * | 5/1986 | Koffel | 416/92 |
| 4,802,828 | A * | 2/1989 | Rutz et al. | 416/241 B |
| 5,603,603 | A * | 2/1997 | Benoit et al. | 415/173.4 |
| 5,622,638 | A * | 4/1997 | Schell et al. | 219/121.64 |
| 5,756,217 | A | 5/1998 | Schroder et al. | |
| 6,039,531 | A * | 3/2000 | Suenaga et al. | 415/115 |
| 6,502,304 | B2 * | 1/2003 | Rigney et al. | 29/889.21 |
| 6,616,410 | B2 * | 9/2003 | Grylls et al. | 416/224 |
| 6,755,619 | B1 | 6/2004 | Grylls et al. | |
| 2002/0141869 | A1 | 10/2002 | Lee et al. | |
| 2002/0170176 | A1 | 11/2002 | Rigney et al. | |
| 2003/0082054 | A1 | 5/2003 | Grylls et al. | |
| 2004/0197190 | A1 | 10/2004 | Stec et al. | |

FOREIGN PATENT DOCUMENTS

| | | |
|---|---|---|
| DE | 19824583 | 12/1999 |
| EP | 0661415 | 7/1995 |

OTHER PUBLICATIONS

European Search Report for Application No. 06 25 4794 dated Sep. 23, 2008.

Applicants rely on the content on the Search Report for indicating the relevance of EP 0661415 and DE 19824583A1 (non-English language references).

* cited by examiner

*Primary Examiner* — Nathaniel Wiehe
(74) *Attorney, Agent, or Firm* — Nixon & Vanderhye, P.C.

(57) ABSTRACT

A bucket for a steam turbine includes an airfoil portion having a radially outer tip, the radially outer tip having a thermal barrier coating applied thereto, and wherein the thermal barrier coating is resurfaced to form at least one ridge along the radially outer tip.

10 Claims, 2 Drawing Sheets

STEAM-COOLED GAS TURBINE BUCKER FOR REDUCED TIP LEAKAGE LOSS

BACKGROUND OF THE INVENTION

This invention relates to steam turbine buckets generally and to the incorporation of a tip leakage loss reduction feature in the thermal barrier coating applied to the bucket tip.

The radially outer tips of gas turbine buckets serve in a hostile environment of both high temperature and high rotationally-induced stress. The life of parts subjected to these conditions is typically limited by low-cycle fatigue (LCF) and creep considerations. In accordance with conventional practice, a tip cap is welded to the bucket as part of a current manufacturing process for hot gas path sealing purposes. The addition of a conventional metal seal to the existing tip cap increases the thermal gradient at the tip, however, and therefore degrades the LCF and creep life. In prior art buckets, this is overcome by employing film cooling in the bucket tip region. In closed-loop steam-cooled turbine bucket applications, however, airfoil film cooling cannot be practically applied, as there is only a single closed cooling circuit. A shroud covering the tip gap and cantilevered across the blade-to-blade gap, as typically applied on stage 2 and stage 3 buckets, is likewise not practical in the first stage due to LCF and creep considerations.

Air-cooled buckets typically have a metallic "squealer tip" feature; however, this approach is cast into the bucket which is not feasible for steam-cooled buckets. Thus, current closed-loop steam-cooled stage 1 buckets have no feature to impede fluid flow into the tip gap. As a result, leakage flow rolls into a vortex, causing a reduction in turbine efficiency by two means. First, the tip flow generates no lift, and contributes no power-producing torque on the turbine rotor. Second, the tip vortex mixes out with the surrounding flow downstream of the bucket, generating mixing loss.

BRIEF DESCRIPTION OF THE INVENTION

This invention, in one exemplary embodiment, seeks to provide various geometry features on the tip cap to impede tip leakage loss without degrading LCF and creep life of a closed-loop steam-cooled bucket.

In the exemplary embodiment, the thickness of a thermal barrier coating (TBC) material applied to the bucket tips (references to the "tips" include the welded-on tip cap unless otherwise noted) is increased sufficiently to allow a cavity to be machined or ground into the TBC coating in the bucket tip center portion, along the main camber line of the tip. The cavity therefore also defines a ridge about the perimeter of the bucket (at the edge or offset from the edge), along both the suction and pressure surfaces, similar to a conventional squealer tip. A ridge formed along only the pressure side, or only the suction side of the airfoil is also contemplated. In still another variation, a single ridge may be formed along the mean camber line of the TBC-coated bucket tip for the purpose of effectively reducing the tip gap over a rotating unshrouded bucket.

By machining or grinding (or otherwise resurfacing by any suitable means) these or similar geometries into the thermal barrier coating applied to the bucket tip, the flow of fluid in the gas path from the pressure surface to the suction surface through the tip gap between the rotating bucket and the stationary shroud over the bucket is impeded. The thermal barrier coating also reduces the heat flux into the bucket tip base metal. The reduction in heat flux will reduce the thermal gradient through the base metal of the tip. This reduction in thermal gradient significantly enhances the LCF and creep life of the bucket tip.

Accordingly, the present invention relates to a bucket for a steam turbine comprising an airfoil portion having a radially outer tip, the radially outer tip having a thermal barrier coating applied thereto, and wherein the thermal barrier coating is resurfaced to form at least one ridge along the radially outer tip.

In another aspect, the present invention relates to a bucket for a steam turbine comprising an airfoil portion having a radially outer tip, the radially outer tip having a thermal barrier coating applied thereto, and wherein a cavity is formed in a center portion of the thermal barrier coating along the radially outer tip.

In still another aspect, the present invention relates to a method of reducing tip leakage loss at a radially outer tip of a turbine bucket comprising: (a) coating the radially outer tip of the bucket with a thermal barrier coating; (b) resurfacing the thermal barrier coating to include at least one tip leakage loss feature in the coating, extending substantially the entire length of the tip.

The invention will now be described in detail in connection with the drawings identified below.

DETAILED DESCRIPTION OF THE INVENTION

Figure 1:
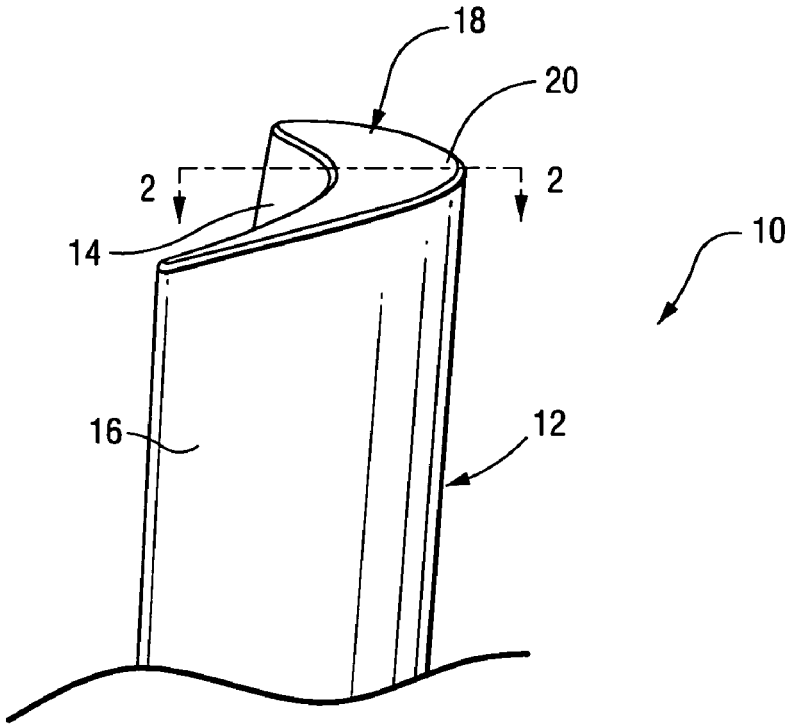
Fig. 1 (PRIOR ART)
FIG. 1 is a partial perspective view of a known closed circuit, steam-cooled turbine bucket.
Figure 2:
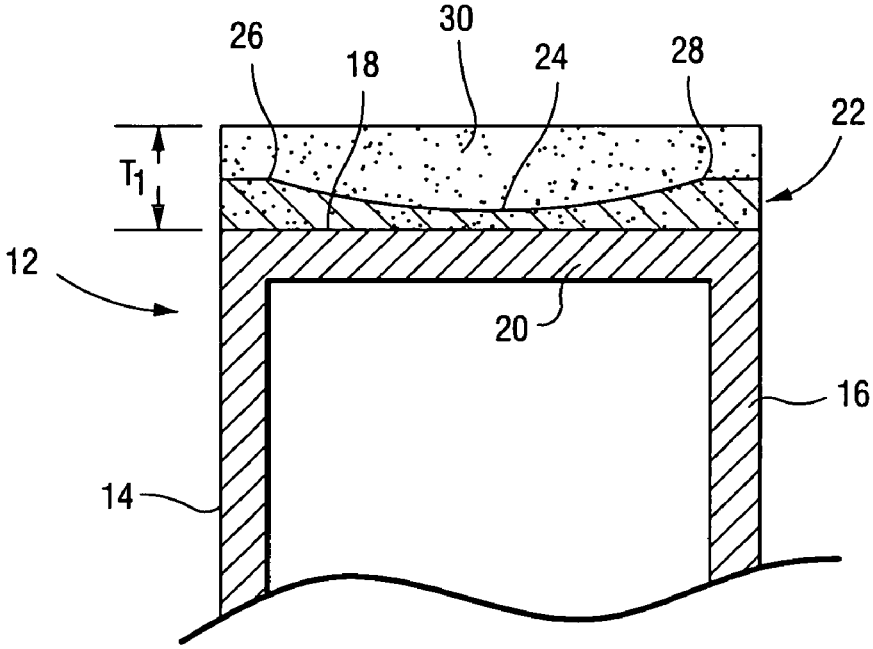
FIG. 2 is a section taken along the line 2-2 of FIG. 1 but with a tip leakage loss feature formed in the bucket tip cap coating.

FIG. 1 illustrates a conventional closed-circuit, steam-cooled bucket for a steam turbine first stage. The bucket 10 is formed with an airfoil portion 12 including a pressure surface (or side) 14 and a suction surface (or side) 16. The radially outer tip 18 of the bucket is closed by a tip cap 20 that is welded in place and subsequently sprayed with an otherwise conventional thermal barrier coating (TBC) 22 (FIG. 2). Platform and mounting (e.g., dovetail) portions (not shown) of the bucket are otherwise conventional and need not be described.

In the example portrayed in FIG. 2, the thermal barrier coating 22 is increased in thickness to $T_1$ in order to provide sufficient coating material to accommodate a tip leakage loss-reduction feature as explained below. More specifically, in the FIG. 2 example, the coating 22 is machined to reduce the overall thickness of the coating and to form a cavity 24 in the center region of the tip cap, running along the mean camber line of the bucket tip, substantially the entire length of the tip. The cross-hatched coating represents the finished, machined or ground configuration, while the coating material 30 above the cross-hatched portion is removed. Cavity 24 thus creates ridges 26, 28 that extend along the pressure and suction surfaces 14, 16, respectively, and about the perimeter of the bucket tip, but offset inwardly from the 90° C. tip cap edge. In the exemplary embodiment, the minimum TBC coating thickness at the center of cavity 24 may be on the order of 30 mils, while the thickness at the ridges 26, 28 may be up to about 60 mils, and the depth of the cavity 24 may be between about 30 and 6 mils. $T_1$ may be from about 60 to about 110 mils. It will be appreciated that the exact coating thicknesses at the various locations on the tip cap will vary depending on bucket size, tip clearance requirements and the like. This bucket tip surface feature impedes tip-leakage loss without degrading the LCF and creep life of the bucket.

Figure 3:
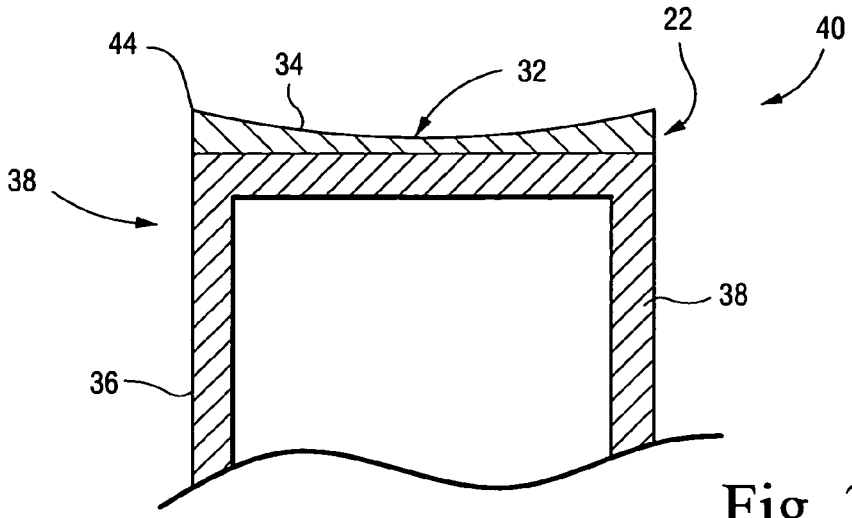
FIG. 3 is a section similar to FIG. 2 but illustrating a second exemplary embodiment of the invention.
Figure 4:
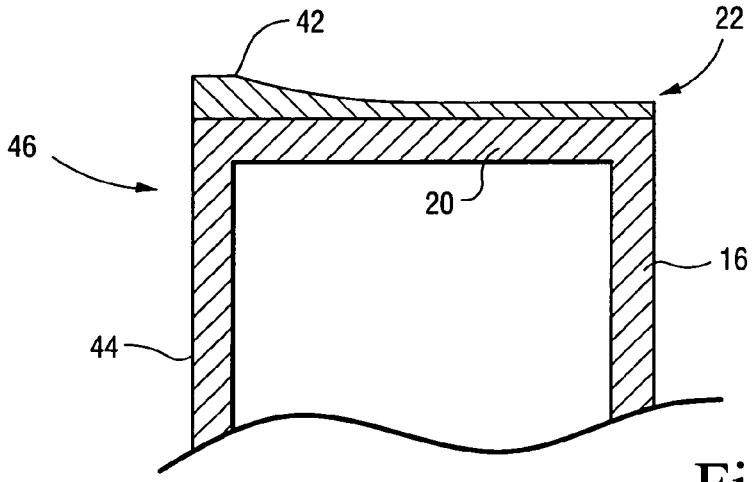
FIG. 4 is a section similar to FIG. 2 but illustrating a third exemplary embodiment of the invention.

It will be appreciated that other bucket tip surface features are within the scope of this invention. For example, in FIG. 3, the cavity 32 is defined by a smoothly curved surface 34 extending continuously from the suction side 36 to the pressure side 38 of the airfoil 40, forming a ridge 41 about the edge of the tip. Alternatively, as shown in FIG. 4, a machined ridge 42 could be formed in the TBC coating along only the suction side 44 of the airfoil, or along only the pressure side of the airfoil (not shown), by simply eliminating one side of the cavity.

Figure 5:
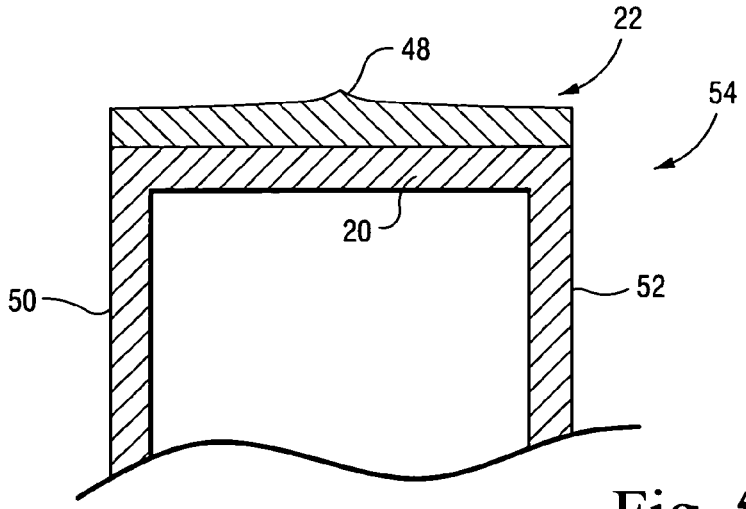
FIG. 5 is a section similar to FIG. 2 but illustrating a fourth exemplary embodiment of the invention.

FIG. 5 illustrates another surface feature in the form of a ridge or rib 48 machined or ground into the coating along the mean camber line, equidistantly spaced from the suction side 50 and pressure side 52 of the airfoil 54. In fact, any surface feature machined into the TBC-coated bucket tip for the purpose of effectively reducing the tip gap over a rotating unshrouded bucket is contemplated. It is also to be understood that the incorporation of various geometries on the tip cap coating is not necessarily limited to buckets with closed-loop steam cooling circuits, although the latter is the most likely application. It could also be applied to conventional air-cooled buckets.

Reduction of tip loss improves component efficiency and thereby improves the efficiency and the power output of the gas turbine. This in turn reduces the amount of pollutants emitted into the environment for a given amount of power production, and improves the operating economics of the gas turbine power plant.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A stage-one, steam-cooled bucket for a steam turbine comprising an airfoil portion incorporating a closed-loop steam cooling circuit and having a radially outer tip cap secured thereto, said radially outer tip cap covered with a thermal barrier coating, and wherein said thermal barrier coating is provided with a cavity defined by an area of reduced coating thickness in said thermal barrier coating extending along at least a center portion of said radially outer tip cap, wherein said cavity forms a ridge along only said suction side of said airfoil portion.

2. The bucket of claim 1 wherein said cavity has a depth of 30-60 mils.

3. A stage-one, steam-cooled bucket for a steam turbine comprising an airfoil portion incorporating a closed-loop steam cooling circuit and having a radially outer tip cap secured thereto, said radially outer tip cap covered with a thermal barrier coating, and wherein said thermal barrier coating is provided with a cavity defined by an area of reduced coating thickness in said thermal barrier coating extending along at least a center portion of said radially outer tip cap, wherein said cavity forms a ridge along only said pressure side of said airfoil portion.

4. The bucket of claim 3 wherein said cavity has a depth of 30-60 mils.

5. A method of reducing tip leakage loss at a radially outer tip of a stage-one, steam-cooled turbine bucket comprising:

(a) providing a stage-one, steam turbine bucket incorporating a closed-loop steam cooling circuit;

(b) covering substantially entirely the radially outer tip of the bucket with a thermal barrier coating of first predetermined thickness;

(c) resurfacing by machining or grinding all of the thermal barrier coating to reduce said first predetermined thickness and including resurfacing the thermal barrier coating in selected portions of said thermal barrier coating to thereby define a ridge in said coating, extending along only a pressure side of said bucket and along substantially the entire length of said radially outer tip.

6. The method of claim 5 wherein said cavity has a depth of between 6 and 30 mils.

7. The bucket of claim 5 wherein said coating has a minimum thickness of about 30 mils.

8. A method of reducing tip leakage loss at a radially outer tip of a stage-one, steam-cooled turbine bucket comprising:

(a) providing a stage-one, steam turbine bucket incorporating a closed-loop steam cooling circuit;

(b) covering substantially entirely the radially outer tip of the bucket with a thermal barrier coating of first predetermined thickness;

(c) resurfacing by machining or grinding all of the thermal barrier coating to reduce said first predetermined thickness and including resurfacing the thermal barrier coating in selected portions of said thermal barrier coating to thereby define a ridge in said coating, extending along substantially the entire length of said radially outer tip; and wherein said ridge extends along only a suction side of said bucket.

9. The method of claim 8 wherein said cavity has a depth of between 6 and 30 mils.

10. The bucket of claim 8 wherein said coating has a minimum thickness of about 30 mils.

* * * * *

UNITED STATES PATENT AND TRADEMARK OFFICE

CERTIFICATE OF CORRECTION

PATENT NO. : 7,922,455 B2
APPLICATION NO. : 11/228241
DATED : April 12, 2011
INVENTOR(S) : Itzel et al.

It is certified that error appears in the above-identified patent and that said Letters Patent is hereby corrected as shown below:

Front page of patent No. 7,922,455 at INID code (54) and at Column 1, lines 1 and 2, title, delete "STEAM-COOLED GAS TURBINE BUCKER FOR REDUCED TIP LEAKAGE LOSS" and insert --STEAM-COOLED GAS TURBINE BUCKET FOR REDUCED TIP LEAKAGE LOSS--.

Signed and Sealed this
Fourteenth Day of June, 2011

David J. Kappos

David J. Kappos
*Director of the United States Patent and Trademark Office*